US009353992B2

(12) United States Patent
Carow et al.

(10) Patent No.: US 9,353,992 B2
(45) Date of Patent: May 31, 2016

(54) METHOD FOR DRYING CLOTHES IN A HOUSEHOLD DRYER

(71) Applicant: Whirlpool Corporation, Benton Harbor, MI (US)

(72) Inventors: James P. Carow, Saint Joseph, MI (US); Jurij Paderno, Novate Milanese (IT); Paolo Spranzi, Borgosatollo (IT)

(73) Assignee: Whirlpool Corporation, Benton Harbor, MI (US)

( * ) Notice: Subject to any disclaimer, the term of this patent is extended or adjusted under 35 U.S.C. 154(b) by 523 days.

(21) Appl. No.: 13/793,463

(22) Filed: Mar. 11, 2013

(65) Prior Publication Data

US 2013/0276326 A1 Oct. 24, 2013

(30) Foreign Application Priority Data

Apr. 19, 2012 (EP) ..... 12164694

(51) Int. Cl.
*F26B 21/10* (2006.01)
*D06F 58/28* (2006.01)

(52) U.S. Cl.
CPC ..... *F26B 21/10* (2013.01); *D06F 58/28* (2013.01); *D06F 2058/289* (2013.01); *D06F 2058/2829* (2013.01)

(58) Field of Classification Search
CPC . F26B 21/10; D06F 58/28; D06F 2058/2829; D06F 2058/289; D06F 2058/2893
See application file for complete search history.

(56) References Cited

U.S. PATENT DOCUMENTS

| | | | | |
|---|---|---|---|---|
| 3,536,308 | A | 10/1970 | White | |
| 3,864,844 | A * | 2/1975 | Heidtmann | 34/528 |
| 4,622,759 | A * | 11/1986 | Abe et al. | 34/546 |
| 6,199,300 | B1 * | 3/2001 | Heater et al. | 34/446 |
| 2007/0214678 | A1 * | 9/2007 | Son et al. | 34/446 |
| 2012/0090191 | A1 * | 4/2012 | Colombo et al. | 34/282 |

FOREIGN PATENT DOCUMENTS

| | | |
|---|---|---|
| EP | 0388939 A1 | 9/1990 |
| EP | 2441880 A1 | 4/2012 |

OTHER PUBLICATIONS

European Search Report for corresponding EP 12164694.7, Oct. 2, 2012.

* cited by examiner

*Primary Examiner* — David J Laux

(57) ABSTRACT

A method for drying clothes in a household dryer having a drying chamber, a temperature sensor for monitoring temperature an air exhaust temperature from the chamber, and a control system for maintaining a temperature in the drying chamber close to a set point temperature by selecting the set point temperature based on the air exhaust temperature.

17 Claims, 3 Drawing Sheets

METHOD FOR DRYING CLOTHES IN A HOUSEHOLD DRYER

RELATED APPLICATION

This application claims the priority benefit of European Patent Application 12164694.7 filed on Apr. 19, 2012, the entirety of which is incorporated by reference in its entirety.

TECHNICAL FIELD

The present disclosure relates to a method for drying clothes in a household dryer having a drying chamber, at least a temperature sensor for monitoring the temperature of the exhaust air and a closed loop control system for maintaining the drying temperature close to a set point temperature.

BACKGROUND

With the term "exhaust air" we mean the air flowing from the drying chamber, i.e. in the proximity of the air outlet from such chamber. With the term "drying temperature" we mean the reference temperature for controlling the drying process, including the control of the heating element used for heating air entering the drying chamber.

A common practice is to control a tumble dryer heating element by feeding back the exhaust air temperature. The drum output temperature is usually a good approximation of the actual clothes temperature, therefore it is kept under control to avoid an excessive heating of clothes which could damage them.

The feedback is usually made through hysteresis control, i.e. the heater is switched on when the feedback temperature is below a first predefined threshold and switched on when it is above a second predefined threshold. In this way the hysteresis control shows low performance when the temperature of the heater is around the upper temperature limit and it may cause undesired oscillation of the clothes temperature.

Another more advanced way to control the heater is through a PI (proportional-integral) control and PWM (Pulse Width Modulation) control.

In the attached FIG. 1 classic control of a domestic tumble dryer is shown where the input of the control algorithm is the difference between the drum output temperature set point and its current value. The algorithm may be a simple hysteresis control or a PI control, where the output directly manages the heater actuation.

The exhaust temperature set point is fixed and for this reason the control performances are strongly dependent on the working operation conditions. Hence the time/energy performances depend on the mass of the clothes inside the dryer, the water retained by the load, the venting condition and the environment condition.

SUMMARY

An object of the present disclosure is to provide a control method which overcomes the above drawbacks and which can provide shorter drying cycles and energy savings.

Such objects are reached according to methods and dryers having the features listed in the appended claims.

According to the disclosure, an adaptive temperature control selects the set point around the optimum value in terms of energy consumption, drying time and fabric care avoiding at the same time a wide temperature swinging and clothes temperature rising close to the end of the cycle is described.

According to a first embodiment, when a certain time has elapsed from the cycle start, the set point temperature value is set substantially equal to the current drum exhaust temperature. The time threshold may be a constant or a linear combination of other variables such as drying cycle selected by the user, the load mass and the environment temperature.

According to a second embodiment, when exhaust temperature derivative goes below a certain threshold, the set point temperature value is set substantially equal to the current drum exhaust temperature. During the drying cycle, after a first warm up phase where sensible heat is principally transferred to the load with a low evaporation coefficient, in the steady state phase the evaporation starts to be important and at the same time the quantity of sensible heat transferred to the load decreases due to its temperature increasing. Therefore the exhaust temperature derivative is a good estimator of when the steady state condition is reached.

According to a third embodiment, the optimum temperature set point may be also computed making use of the information given by a simplified thermodynamic model of the dryer system. The model may have several input signals and use output values to establish the optimum temperature set point. The input signals to the dryer model can be air temperatures, air humidity and status of the dryer components, such as heating element. The output values used for calculating the optimum set point may be airflow rate, load mass and the residual moisture content of load. Knowing these parameters the set point that optimizes the drying cycle in that predicted condition is then estimated.

BRIEF DESCRIPTION OF THE FIGURES

Further advantages and features of the present disclosure will become clear from the following detailed description, with reference to the attached drawings in which.

DETAILED DESCRIPTION

Figure 1:
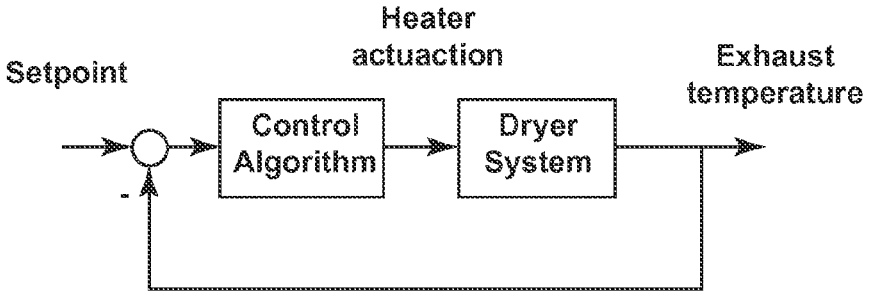
FIG. 1 (PRIOR ART)
FIG. 1 is a block diagram showing a prior-art way of controlling the drum output temperature of a clothes tumble dryer.
Figure 2:
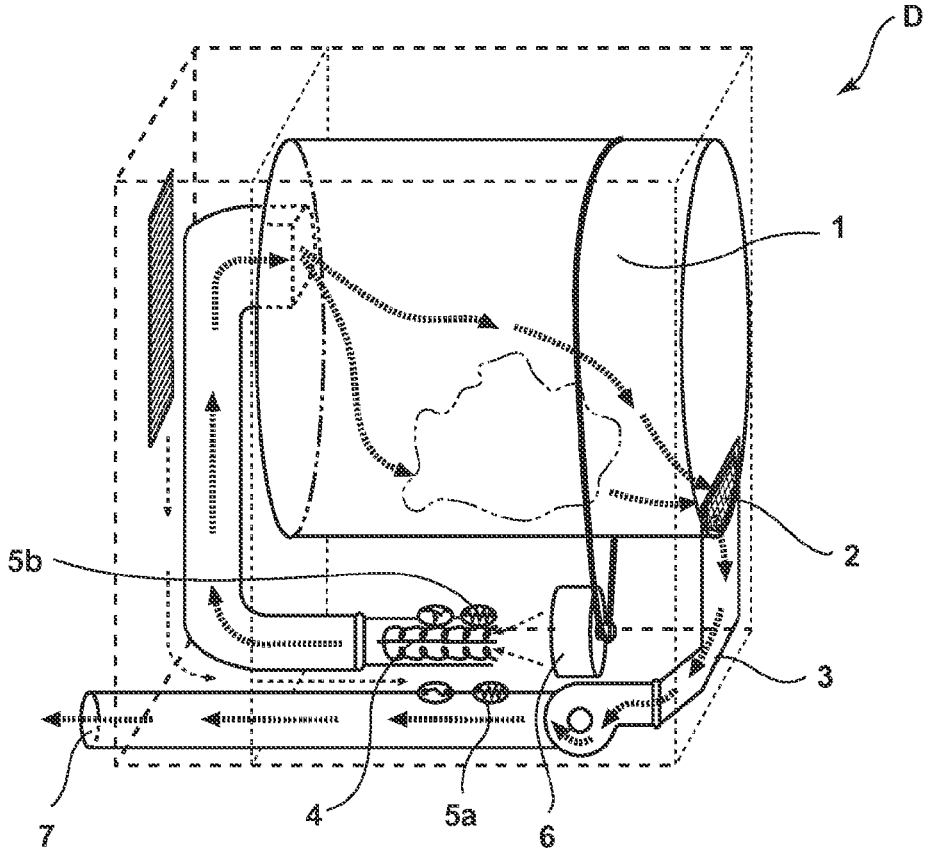
FIG. 2 is a schematic view of an air-vented dryer in which a method according to the disclosure is implemented.

With reference to the drawings, and particularly to FIG. 2, a tumble dryer D comprises a rotating drum 1 actuated by an electric motor 6 containing a certain amount of articles, a screen 2 that collects the lint detaching from the tumbling clothes, an air channel 3 that conveys the air to a vent 7, a heating element 4 that heats the air going into the drum D (resistance, heat pump, etc. . . . ), a temperature sensor 5*a* that measures the temperature of the drum exhaust air and a temperature sensor 5*b* measuring the temperature of the heating circuit, i.e. downstream from the heating element 4. All the sensors and components of the dryer D are connected to a central control unit (not shown) which receives signals from the sensors and drives components according to different drying programs selected by the user and stored therein.

The disclosure is mainly focused on methods to adapt the temperature set point close to the optimum value in terms of energy consumption, drying time and fabric care avoiding wide temperature swings and temperature rising close to the end of the cycle.

The adaptive temperature control chooses the optimum set point according to the value of the exhaust drum temperatures when the system reach the steady state condition, which may be evaluated in different ways.

Figure 3:
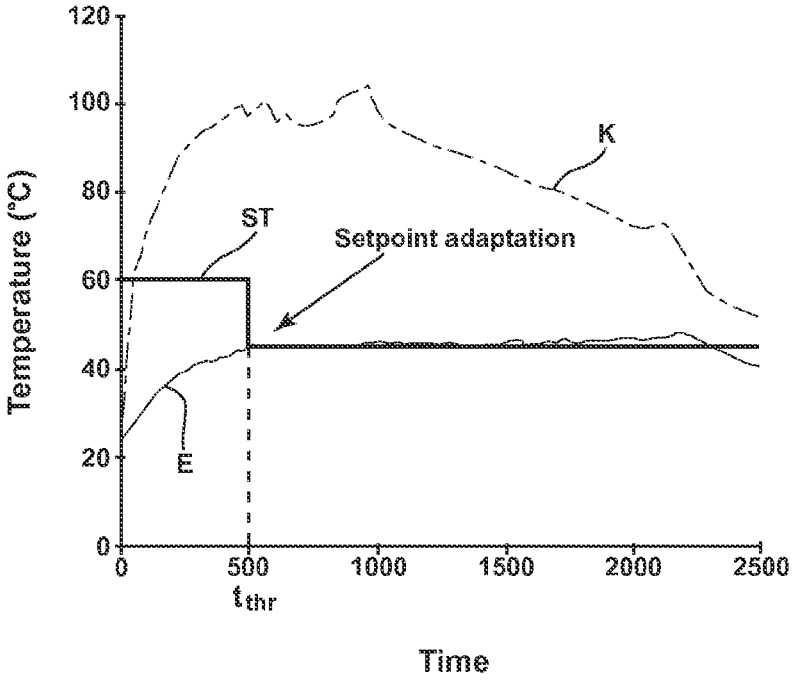
FIG. 3 is a diagram showing how a method according to a first embodiment is carried out.

According to a first embodiment and with reference to FIG. 3, when a certain time threshold $t_{thr}$ from the cycle start is reached, the set point value ST is set equal to the current drum exhaust temperature E. In FIG. 3, the inlet drum temperature K is also shown.

The time threshold may be a constant predetermined value or a linear combination of other variables such as the type of drying cycle selected by the user, the load mass and the environment temperature, as in the following formula:

$$t_{thr}=a+b_1\cdot\text{cycle}+b_2\cdot\text{mass}+b_3\cdot T_{amb}$$

In the above formula, for an air vented dryer modified according to the present disclosure, the following are example constant values:

a=150
$b_1$=1
$b_2$=100
$b_3$=−2 with the following parameters of the drying cycle:

cycle=0
mass=4 (kg)
$T_{amb}$=25(° C.)

Figure 4:
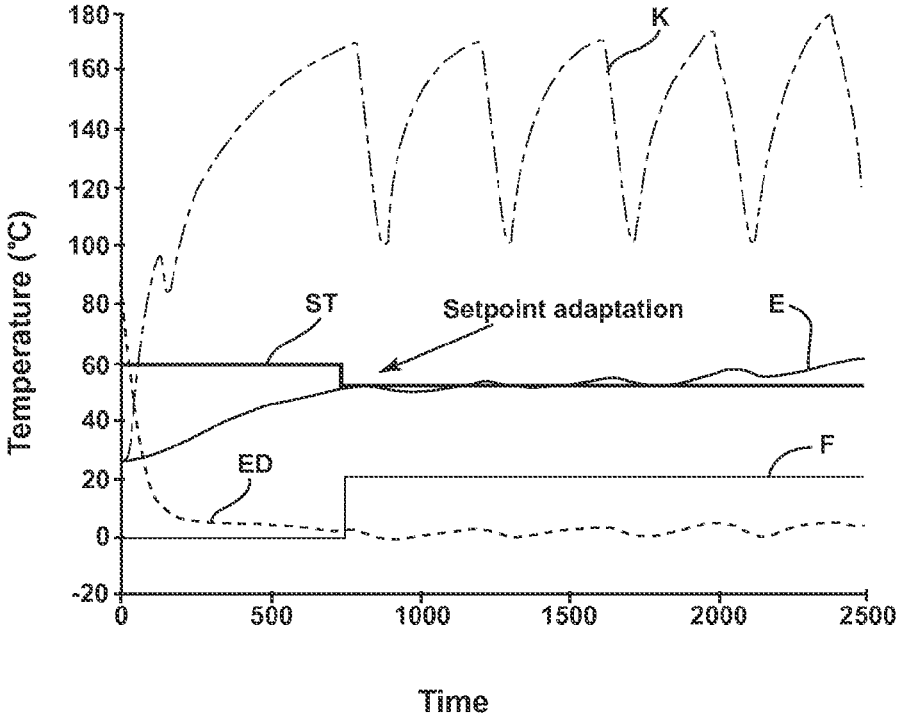
FIG. 4 is a diagram showing how a method according to a second embodiment is carried out.

Similar constants may be found for a different platform (e.g., a condenser dryer, a heat pump dryer, a hybrid heat pump, etc.), According to a second embodiment shown in FIG. 4, when an exhaust temperature derivative ED goes below a certain threshold, the set point temperature value ST is set equal or close to the current drum exhaust temperature E. As shown in FIG. 4, after a first warm up phase where sensible heat is principally transferred to the load with a low evaporation coefficient, in the subsequent steady state phase the evaporation starts to be important and at the same time the quantity of sensible heat transferred to the load decreases hence its temperature increases. Therefore the exhaust temperature derivative ED is a good estimator of the steady state condition. In FIG. 4 the same references of FIG. 3 are used, i.e. K for inlet drum temperature, ST for set temperature value, E for the exhaust temperature. In FIG. 4 the reference F indicates the flag for the steady state.

FIG. 4 illustrates a test carried out on an air vented dryer modified according to the present disclosure; similar results may be obtained with a different platform (e.g., a condenser dryer, a heat pump dryer, a hybrid heat pump, etc.), in which the exhaust derivative is computed as:

$$\dot{T}_{exh}=\frac{T_{exh}(t-1)-T_{exh}(t)}{\text{clock}(t-1)-\text{clock}(t)}$$

The quantity $\dot{T}_{exh}$ is then filtered with an IIR filter initialized at 100° C./s, obtaining $\dot{T}_{exh_filt}$. When the value of $\dot{T}_{exh_filt}$ is less than 0.2° C./s the exhaust set point value ST is adapted from the initial value to the actual exhaust temperature E rounded at the closest integer, in the example from 60° C. to 51° C.

Figure 5:
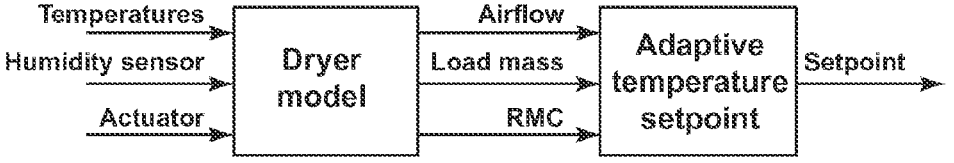
FIG. 5 is a block diagram showing an adaptive temperature control architecture used in a third embodiment.
Figure 6:
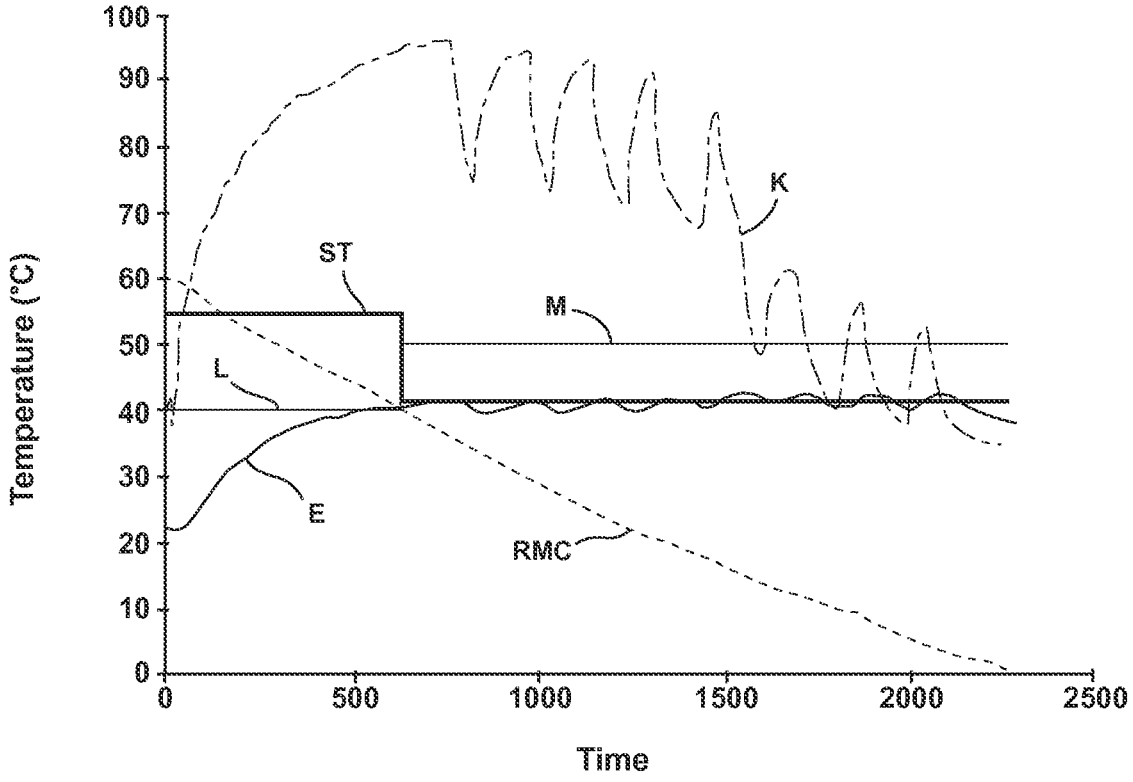
FIG. 6 is a diagram showing how a method according to the third embodiment is carried out.

FIGS. 5 and 6 relate to a third embodiment in which the optimum set point is computed making use of the information given by a simplified model of the dryer system. The information can be respectively humidity, load conductivity or residual moisture content estimated (RMC). The temperature set point ST is placed equal to the exhaust temperature E when the chosen parameters go below a predetermined threshold. Further system information may provide boundaries in the set point selection such as airflow and/or load mass.

In the methods described above, the choice of temperature set point ST is restricted to a range defined by lower and upper boundaries to avoid wrong estimation that may lead to extended cycle duration or fabric damage.

In the example shown in FIGS. 5 and 6, during the first part of the cycle the fabric load mass and the airflow of the system are estimated. According to those values, the minimum and maximum set point threshold are calculated by means of the following equation, rounded to the next integer value:

$$\text{Setpoint}_{min}=\alpha*\text{airflow}+\beta*\text{LoadMass}+\gamma$$

$$\text{Setpoint}_{max}=\text{Setpoint}_{min}+\Delta$$

where example constants are:

α=−750
β=−0.5
γ=60
Δ=10 and the estimated variables are:

airflow=0.0237 kg/s
LoadMass=4.4662 kg
Hence:
$\text{Setpoint}_{min}$=40° C.
$\text{Setpoint}_{max}$=50° C.

Then the set point value ST is set equal to the exhaust temperature E when the estimated residual moisture content RMC goes below a predetermined value, according to the set point min max boundaries (respectively indicated with references M and L in FIG. 6). If in the time period before reaching this condition the exhaust temperature goes above the $\text{Setpoint}_{max}$, $\text{Setpoint}_{max}$ is set as setpoint ST.

FIG. 6 illustrates a test carried out on an air vented dryer modified according to the present disclosure, the chosen RMC threshold is equal to 40% of starting RMC and the set point goes from the initial default value of 55° C. to 42.43° C.; similar behavior may be obtained with a different platform (e.g., a condenser dryer, a heat pump dryer, a hybrid heat pump, etc.).

The selection of the appropriate temperature set point ST is important and it is one of the drivers of energy consumption and fabric care. By selecting a low set point ST the cycle time is stretched out; on the other hand a high set point ST may be not reached or reached just at the end of the drying cycle, therefore over-heating the fabric when is almost dried.

Without the adaptive temperature set point according to this disclosure, there can be the selection of the wrong set point which causes an increase of the drum exhaust temperature E that means heat losses.

Even though the methods and the dryers according to the present disclosure have been described with reference to an air-vented dryer, the same methods can be used also for heat-pump dryers and condenser dryers as well.

The invention claimed is:

1. A method for drying clothes in a household dryer having a drying chamber, a temperature sensor for monitoring an air exhaust temperature from the chamber, and a control system for maintaining a temperature in the drying chamber close to a set point temperature by:

setting an air exhaust temperature set point to a first set point temperature value;

determining whether the air exhaust temperature satisfies a steady state condition; and upon satisfaction of the steady state condition, setting the air exhaust temperature set point to a second set point temperature value substantially equal to the current air exhaust temperature.

2. The method according to claim 1, wherein determining whether the air exhaust temperature satisfies a steady state condition comprises calculating a derivative of the air exhaust temperature.

3. The method according to claim 2, wherein determining whether the air exhaust temperature satisfies a steady state condition includes determining when the derivative of the air exhaust temperature falls below a predetermined value.

4. The method according to claim 1, wherein determining whether the air exhaust temperature satisfies a steady state condition comprises monitoring a further sensed parameter and comparing it with a predetermined threshold.

5. The method according to claim 4, wherein the further sensed parameter comprises at least one of an air humidity, a clothes conductivity, a residual moisture content, or combination thereof.

6. The method according to claim 4, wherein the further sensed parameter comprises an estimated residual moisture content.

7. The method according to claim 6, wherein determining whether the air exhaust temperature satisfies a steady state condition includes determining when the estimated residual moisture content is equal or lower than a predetermined value.

8. The method according to claim 1, wherein determining whether the air exhaust temperature satisfies a steady state condition includes determining whether a predetermined time has passed after starting a drying process.

9. The method according to claim 8, wherein the predetermined time is calculated on the basis of a load mass, a selected drying cycle, an ambient temperature, or combination thereof.

10. The method according to claim 9, wherein said predetermined time is calculated according to the following formula:

$$t_{thr}=a+b_1\cdot\text{cycle}+b_2\cdot\text{mass}+b_3\cdot T_{amb}$$

where a, b1, b2 and b3 are predetermined constants, cycle is an integer linked to the drying cycle, mass is a load mass and Tamb is an ambient temperature.

11. The method according to claim 1 further comprising maintaining the temperature in the drying chamber at the second set point temperature.

12. The method according to claim 1 further comprising setting the second set point temperature less than the first set point temperature.

13. A clothes dryer comprising:

a drying chamber;

a temperature sensor for monitoring an air exhaust temperature from the drying chamber; and a heating element;

a control system configured to set an air exhaust temperature in the drying chamber to a first set point temperature, determine whether the air exhaust temperature satisfies a steady state condition, and upon satisfying the steady state condition, set the air exhaust temperature to a second set point temperature substantially equal to the current air exhaust temperature;

wherein the control system sets the air exhaust temperature in the drying chamber to the first set point temperature, determines whether the air exhaust temperature satisfies the steady state condition, sets the air exhaust temperature to the second set point temperature, and operates the heating element according to the first and second set point temperatures.

14. The clothes dryer according to claim 13, wherein the second set point temperature is less than the first set point temperature.

15. The clothes dryer according to claim 13, wherein the control system is configured to set the air exhaust temperature to the second set point temperature after a predetermined time has passed after starting a drying process.

16. The clothes dryer according to claim 13, wherein the control system is configured to determine whether the air exhaust temperature satisfies a steady state condition by calculating a derivative of the air exhaust temperature.

17. The clothes dryer according to claim 13, wherein the control system is configured to determine whether the air exhaust temperature satisfies a steady state condition by monitoring a further sensed parameter and comparing it with a predetermined threshold.

* * * * *